US008245677B2

(12) United States Patent
Kleiber

(10) Patent No.: US 8,245,677 B2
(45) Date of Patent: Aug. 21, 2012

(54) LOCKING ELEMENT FOR CAMSHAFT ADJUSTORS

(75) Inventor: Thomas Kleiber, Herzogenaurach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 511 days.

(21) Appl. No.: 12/299,363

(22) PCT Filed: Apr. 11, 2007

(86) PCT No.: PCT/EP2007/053494
§ 371 (c)(1),
(2), (4) Date: Jan. 12, 2009

(87) PCT Pub. No.: WO2007/128640
PCT Pub. Date: Nov. 15, 2007

(65) Prior Publication Data

US 2009/0114502 A1 May 7, 2009

(30) Foreign Application Priority Data

May 3, 2006 (DE) ..... 10 2006 020 314

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 2001/0011534 | A1 | 8/2001 | Sugawara et al. | |
| 2001/0054405 | A1 | 12/2001 | Miyasaka | |
| 2002/0139332 | A1 | 10/2002 | Takenaka | |
| 2003/0062011 | A1 | 4/2003 | Hori | |
| 2003/0217716 | A1 | 11/2003 | Kusano et al. | |
| 2006/0081204 | A1 | 4/2006 | Bilic et al. | |
| 2006/0266318 | A1 * | 11/2006 | Suga et al. | 123/90.17 |

FOREIGN PATENT DOCUMENTS

| | | |
|---|---|---|
| DE | 10045418 | 4/2001 |
| DE | 102004019190 | 11/2005 |
| JP | 2001050017 | 2/2001 |

* cited by examiner

*Primary Examiner* — Zelalem Eshete
(74) *Attorney, Agent, or Firm* — Volpe and Koenig, P.C.

(57) ABSTRACT

The present invention relates to an insert element (3) for transmitting a force for a camshaft adjustment system. The insert element (3) has a first region (1) with an end surface (4) for receiving the force, and a second region (2) for conducting away the force. The end surface (4) is arranged in such a manner that it has, by means of a locking element (7), at least one force transmission point for receiving the force. The second region (2) is arranged in such a manner that it has, by means of a stator element (6), a force transmission surface for conducting away the force.

14 Claims, 4 Drawing Sheets

LOCKING ELEMENT FOR CAMSHAFT ADJUSTORS

FIELD OF THE INVENTION

The present invention relates to an insert element, to a locking arrangement and to a method for transmitting a force for a camshaft adjustment system for a motor vehicle, and to the use of an insert element for transmitting a force for a camshaft adjustment system in a motor vehicle.

BACKGROUND

In modern motor vehicles, use is made of camshaft adjustment systems which can control the valve opening times of internal combustion engines. The valve opening times are controlled via a camshaft. The camshaft is composed of "cams" which are fitted on a shaft. When the shafts rotate, the cams come into contact with, for example, a valve lever such that the latter opens the valve in order therefore either to conduct a fuel mixture into the cylinder of an internal combustion engine or, after the combustion process, to conduct the exhaust gases out of the cylinder.

The valve opening times are determined via the arrangement of the cams and via the speed of rotation of the camshaft. The camshaft is usually coupled for driving to the crankshaft of the internal combustion engine. If the connection between the camshaft and the crankshaft comprises a fixed, unchangeable connection, the valve opening times already have to be determined at an early construction stage of the engine. A subsequent adjustment of the valve opening times during operation of the engine is no longer possible.

In order to make this possible, use is made of camshaft adjustment systems which make it possible to control the valve clearance even during operation of an engine. One possible realization of a camshaft adjustment system is implemented by a hydraulic controller DE 10 2004 019 190. In order to transmit force, a driven part or rotor element, which is fitted in a rotationally fixed manner, is fastened to the end of a camshaft and is designed in order to transmit force to a driving wheel or stator element connected in a rotationally fixed manner to the crankshaft. Rotation of the driving wheel and of the driven wheel in a specific manner therefore makes it possible to adjust the valve opening times between the crankshaft and the camshaft.

In order to realize this relative change in the phase position between the camshaft and crankshaft, the phase can be ensured via hydraulic camshaft adjustment systems. In a pressure chamber, wings fitted in a rotationally fixed manner to the driving part form a first and a second pressure chamber. The relative position of the camshaft to the crankshaft can be adjusted in accordance with the ratio of the pressure level of the first and second pressure chambers. However, if hydraulic pressure is absent, the camshaft has a considerable amount of play, since the wings can move freely in the pressure chambers. In addition, the hydraulic oil pressure is generally built up by a motor vehicle pump which provides the hydraulic pressure as a function of rotational speed. If the oil pressure abruptly ceases, as, for example, in the event of the engine stalling or during starting operations of an engine, it is important to fix the camshaft in a fixed ratio to the crankshaft.

For this purpose, use is made of "locking pins" which are located in bores of the rotor element. The locking pins comprise a sleeve into which an extendable part can retract and extend by means of a spring. If the oil pressure ceases, the spring force causes the locking pin to extend and reach into the cutouts, for example, of a closure cover, thus preventing play between the camshaft and crankshaft.

SUMMARY

It is an object of the invention to improve a transmission of force between a camshaft and a crankshaft.

The object is achieved by an insert element, an arrangement and a method for transmitting a force in a camshaft adjustment system, and by use of an insert element in a camshaft adjustment system.

An an exemplary embodiment, an insert element is provided for transmitting a force for a camshaft adjustment system. The insert element has a first region with an end surface for receiving the force, and a second region for conducting away the force. The end surface is arranged in such a manner that it has at least one force transmission point for receiving the force, wherein the force transmission point is arranged in such a manner that it can be coupled to a locking element. The second region is arranged in such a manner that it has a force transmission surface for conducting away the force, wherein the force transmission surface is arranged in such a manner that it can be coupled to a stator element.

In a further exemplary embodiment, a locking arrangement is provided for transmitting a force for a camshaft adjustment system. According to an exemplary embodiment, the locking arrangement has a locking element, a stator element and an above-described insert element.

In a further exemplary embodiment, a method is provided for transmitting a force for a camshaft adjustment system. A force is received by a locking element by means of at least one force transmission point of an end surface of an insert element and is conducted away from the insert element to a stator element by means of a force transmission surface of the insert element.

In a further exemplary embodiment, the abovementioned insert element is used in a camshaft adjustment system.

The term force transmission point is understood as meaning a force-transmitting connection which is of essentially zero-dimensional design. The term force transmission surface is understood as meaning a force-transmitting connection which is of essentially two-dimensional design. Furthermore, the force transmission point can likewise be of two-dimensional design, with the force transmission point being substantially smaller in its two-dimensional surface than the surface of the force transmission surface. The surface of the force transmission point can be, for example, less than half, less than a third or less than a quarter, of the force transmission surface.

The term rotor element or rotor refers to the components which are connected in a rotationally fixed manner to the camshaft. The term stator element or stator refers to all of the elements which are designed such that they are rotationally fixed to the crankshaft or which transmit the torque of the crankshaft, such as, for example, the stator cover, locking cover, the stator or the locking element.

The present invention provides an insert element and a locking arrangement for transmitting a force for a camshaft adjustment system, which arrangement makes it possible to ensure locking between stator and rotor element of a camshaft adjustment system in the event of a hydraulic pressure drop. The invention comprises an insert element which improves the force flux between a rotor element connected to the camshaft and a stator element operated by the crankshaft. If the hydraulic pressure in the pressure chambers ceases, a locking element moves, for example, a locking pin, which is fastened in the rotor, into a cutout of the stator in order thus to prevent relative rotation between the rotor and the stator even if the hydraulic pressure ceases. During such a connection, high forces occur which have to be transmitted from the camshaft via the locking pin to the crankshaft and vice versa. The force transmission surfaces here are extremely small, and therefore the force flux is concentrated at force transmission points. Exacting requirements are made here of the material in order for the latter to withstand virtually point loading. In addition, the cutout of the stator is often formed in a front cover or locking cover which is connected fixedly to the stator. The concentration of the transmission of force onto a small surface leads to it being necessary for an extremely hard and resistant material to be used for said locking cover, which in turn leads to a high weight and a high cost.

According to the invention, an insert element is now introduced into the force flux, for example between the locking pin and the locking cover. This insert element can receive force from the locking pin in a concentrated manner over a small receiving surface, a "force transmission point", and can conduct it away to the locking cover by means of a force transmission surface which is arranged by design, i.e. purposefully. On account of the distribution of the force flux over the force transmission surface of the insert element, the surface loading ($N/m^2$) of the locking cover is significantly reduced, and therefore lighter and softer materials, such as, for example, aluminium or cast materials, can be used therefor.

Refinements of the insert element are explained below. These refinements also apply to the arrangement and the method and to the use.

According to a further exemplary embodiment, the end surface forms a flat surface. The end surface is arranged in such a manner that it forms a force transmission point with the locking element. By only the end surface bearing with a flat surface against the locking pin, it is therefore possible for a force transmission point to be formed, and therefore a constrained guidance of the end surface is prevented. If, for example, there is a plurality of force transmission points, the locking pin could become jammed, thus causing a constraining force or a clamping force. The locking bolt can no longer be released automatically. By reducing the transmission of force to just one force transmission point, a constraining force is prevented, and therefore the locking pin can always be released.

According to a further exemplary embodiment, the end surface is of concave or convex design. The concave or convex end surface is arranged in such a manner that it corresponds with a concave or convex surface contour of the locking element. When high force fluxes are transmitted, the surface of the force transmission point of the insert part can be increased by the end surface corresponding to a concavely or convexly rounded portion of the locking element. The surface of the force transmission point is therefore increased, and therefore the introduction of force into the insert element takes place in a less concentrated manner. If the radius of the end surface is designed to be somewhat larger than the radius of the locking pin, guidance of the locking pin is ensured without there being the risk of jamming.

According to a further exemplary embodiment of the invention, the concave or convex end surface has at least one groove. The at least one groove is arranged in such a manner that it divides the end surface into a plurality of partial end surfaces. Owing to the grooves between the force transmission points, an exchange of a hydraulic pressure medium or lubricant can be ensured, and therefore the activation or the release and unlocking of the locking device can take place in an improved manner. In addition, a relative movement can take place between the rotor and the stator element, thus causing the formation of frictional points on the insert element. Wear at the frictional points can be reduced by means of the lubrication.

According to another exemplary embodiment, the end surface is arranged in such a manner that it can be coupled to a locking element which has a tapering surface. It has turned out that, by use of a conical locking element, the unlocking and locking can be improved. When the hydraulic pressure ceases, a locking pin with a tapering point can be introduced more easily into a designated cutout in the stator. Accordingly, it is advantageous if the insert element corresponds to this tapering surface of the locking pin, thus significantly improving the transmission of force at the force transmission points. In this case, the angle of taper may be greater than 15 or 20 degrees.

According to a further exemplary embodiment of the present invention, the second region is arranged in such a manner that it can be fastened in a receiving region of the stator element. Use can be made here of fastening elements, such as, for example, screwing, welding, press-fitting or riveting.

According to a further exemplary embodiment, the second region can be fastened in the receiving region in such a manner that at least one degree of freedom can be provided between the second region of the insert element and the stator element. In the case of camshaft adjustment systems, a play often arises between the rotor and the stator and has to be compensated for by the insert element. If the receiving region of the stator element is configured in such a manner that the insert element can be mounted with at least one degree of freedom in the direction of the play between rotor and stator, then the insert element can move freely and therefore an improved transmission of force arises. The insert element often has to be able to move multi-dimensionally in order to follow the relative movements between stator and rotor. In this case, the second region of the insert element can have a curvature with a radius which corresponds to the radius of the possible movement of the rotor relative to the stator.

Refinements of the arrangement are explained below. These refinements also apply to the insert element and to the method and to the use.

According to a further exemplary embodiment of the locking arrangement, the insert element can be mounted in the cutout by means of a floating mounting. When the insert element is mounted with a plurality of degrees of freedom, wear may occur due to the movement between the rotor and the stator. In order to prevent this, the insert element can be mounted in a floating manner, i.e. can be supplied with a hydraulic lubricant in order thus to extend the service life.

According to a further exemplary embodiment of the locking arrangement, the stator element has a groove for supplying a bearing liquid for the cutout. In order to supply the cutout with a hydraulic lubricant, the hydraulic lubricating liquid can be supplied via a groove in the stator element.

According to a further exemplary embodiment of the locking arrangement, the locking element is designed as a locking pin, wherein the locking pin has an end region with a conical surface contour. The end region and the end surface form the at least one force transmission point.

Refinements of the method are explained below. These refinements also apply to the insert element and the arrangement, and to the use.

According to a further exemplary embodiment of the method, the insert element is fastened to a receiving region of the stator element, wherein the insert element is fastened in such a manner that at least one degree of freedom is provided between the second region and the stator element.

With the present invention, an effective locking arrangement for fixing a camshaft to a crankshaft in a rotationally fixed manner is therefore provided. With the insert element according to the invention for transmitting the force between the camshaft and the crankshaft, a force can advantageously be received in a concentrated manner and output in a distributed manner in such a way that the associated components can be selected to be significantly lighter and more cost-effective. For example, a broad distribution of the force flux to a locking cover enables a material based on casting or aluminium to be used. The insert part according to the invention can be used, for example, in internal combustion engines of motor vehicles or ships.

BRIEF DESCRIPTION OF THE DRAWINGS

Exemplary embodiments are described in more detail below with reference to the attached drawings for further explanation and improved understanding of the present invention. In the drawings.

DETAILED DESCRIPTION OF THE PREFERRED EMBODIMENTS

Identical or similar components in the various figures are provided with the same reference numbers. The illustrations in the figures are schematic and are not to scale.

Figure 1:
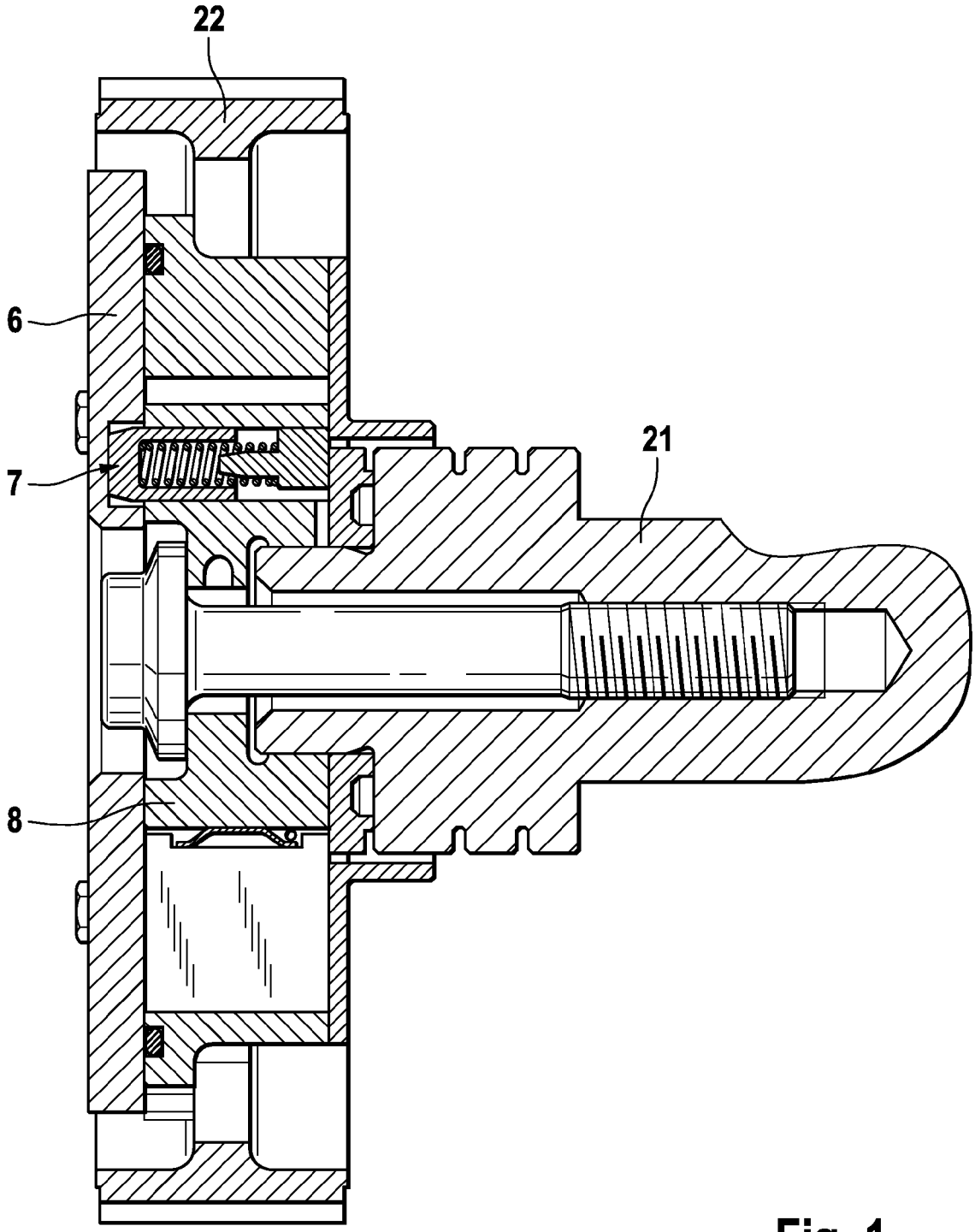
FIG. 1 shows a side view of a camshaft adjustment system.

FIG. 1 shows an illustration of a camshaft adjustment system. A rotor element 8 is fastened in a rotationally fixed manner at one end on a camshaft 21. The locking element 7 is fastened in the rotor element 8 and, when the hydraulic pressure ceases, can be extended by spring force into a cutout 9 of the stator element 6. In addition, a camshaft connection 22, which can transmit a torque of the crankshaft, is illustrated. The stator element may likewise be designed as a locking cover 6 which is connected in a rotationally fixed manner to the crankshaft 22. The relative phase position of the rotor element 8 to the stator element 6 is set via a hydraulic pressure in two chambers (not illustrated) in each case. When the hydraulic pressure ceases, a fixing of the relative position of the rotor element 8 to the stator element 6 in a manner independent of the hydraulic pressure is necessary. If the spring force of the locking element 7 exceeds the hydraulic pressure, then the locking element 7 is retracted by the spring force counter to the hydraulic pressure into the cutout 9 of the stator element 6. If the locking pin is extended into the cutout 9, then the rotor element 8 is fixed to the stator element or to the locking cover in a rotationally fixed manner and, as a result, the camshaft 21 in turn is connected to the crankshaft in a rotationally fixed manner.

It is clear in FIG. 1 that the entire force flux between the rotor element 8 and the locking cover 6 runs via the locking element 7. Whereas the introduction of force into the locking element 7 runs over the entire width of the rotor element 8, the force is output in the locking cover 6 in a concentrated manner over a small surface.

Figure 2:
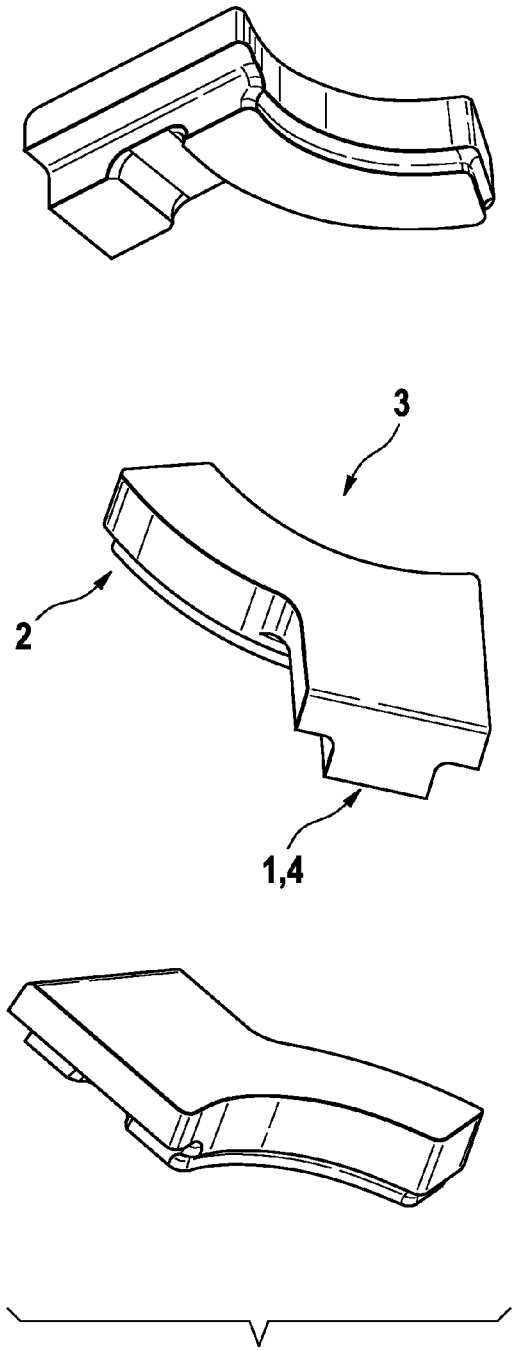
FIG. 2 shows an exemplary embodiment of the insert element with a flat end surface.

FIG. 2 shows an exemplary embodiment of the insert element according to the invention. The insert element can be placed between the locking cover 6 and the locking element 7 (see FIG. 1). Via the end surface 4 of the first region, a force transmission point is formed by means of the locking element 7 such that the force can be received in a concentrated manner and can be output in a distributed manner over the entire surface of the second region to the stator element or the locking cover 6. The insert element 3 is preferably formed from a very hard material, since sometimes surface loadings of up to 5000 $N/m^2$ to 10 000 $N/m^2$ may occur.

Figure 3:
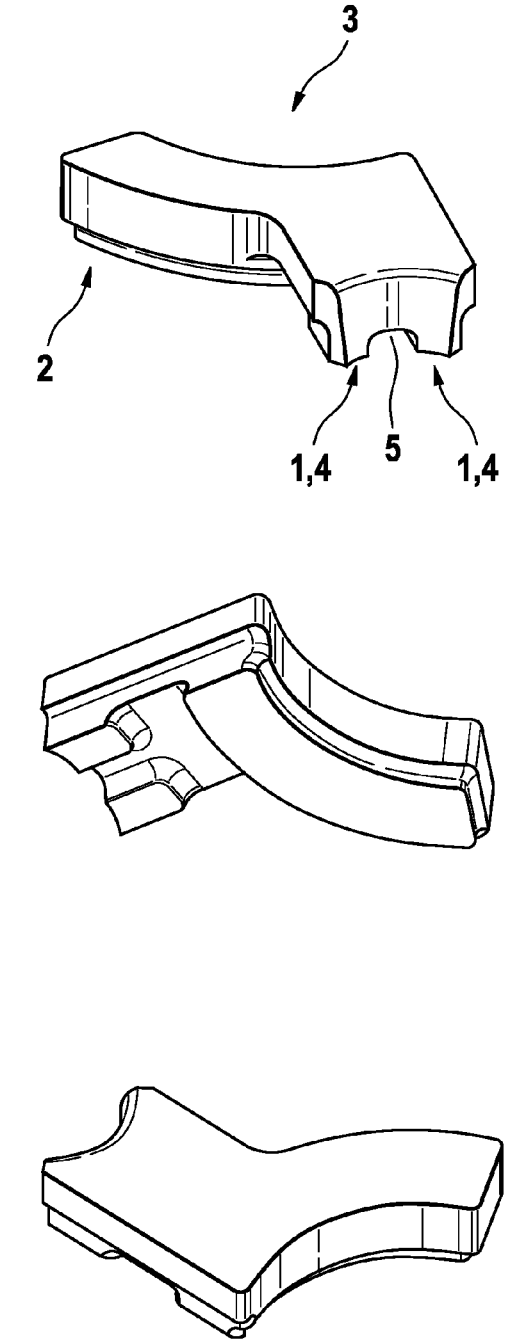
FIG. 3 shows an exemplary embodiment of the insert element with a rounded end surface.

FIG. 3 illustrates an exemplary embodiment of the insert element 3. The insert element 3 here has a first region 1 with an end surface 4 for receiving the force and a second region 2 for conducting away the force. The end surface 4 is arranged in such a manner that it has, by means of a locking element 7, at least one force transmission point for receiving the force, wherein the second region 2 is arranged in such a manner that it has, by means of a stator element 6, a force transmission surface for conducting away the force.

In the case of the insert element 3, the end surface 4 can be of curved design such that this curved end surface can nestle against a round or cylindrical locking pin. This creates a larger force transmission surface. The transmission of force therefore takes place in a less concentrated manner in a force transmission point. The material loading of the insert element is therefore reduced. The radius of the rounded end surface 4 can correspond to the radius of the locking element 7. However, the force transmission points of the end surface 4 should be distributed around the locking pin 7 such that a radial play is possible, in order to avoid constraining forces. Since the rotor element and the stator element are mutually mounted with a degree of play, it is entirely possible for movements of some tens of degrees to occur between the insert element 3 and the locking element 7.

In addition, in FIG. 3, the end surface 4 has a groove 5 in order therefore to ensure the flow of hydraulic lubricant or pressure medium. In addition, a radial play can be created by means of the groove 5 in order therefore to avoid the risk of constraining forces.

In the case of the insert element 3 in FIGS. 2 and 3, the second region 2 is illustrated in a curved manner and forms an annular surface. With the aid of this annular surface, the insert element 3 can be placed into a cutout 9 of the stator element 6. The radius of the annular surface corresponds to the radius of movement of the rotor element 8 relative to the stator element 6. In the event that the cutout 9 provides at least one degree of freedom in the second region 2 of the insert element 3, the insert element can move in accordance with the movement between the rotor element 8 and the stator element 6 and can transmit the force flux in an improved manner. The end surface can therefore move with the movement and can remain bearing against the locking pin 7.

Figure 4:
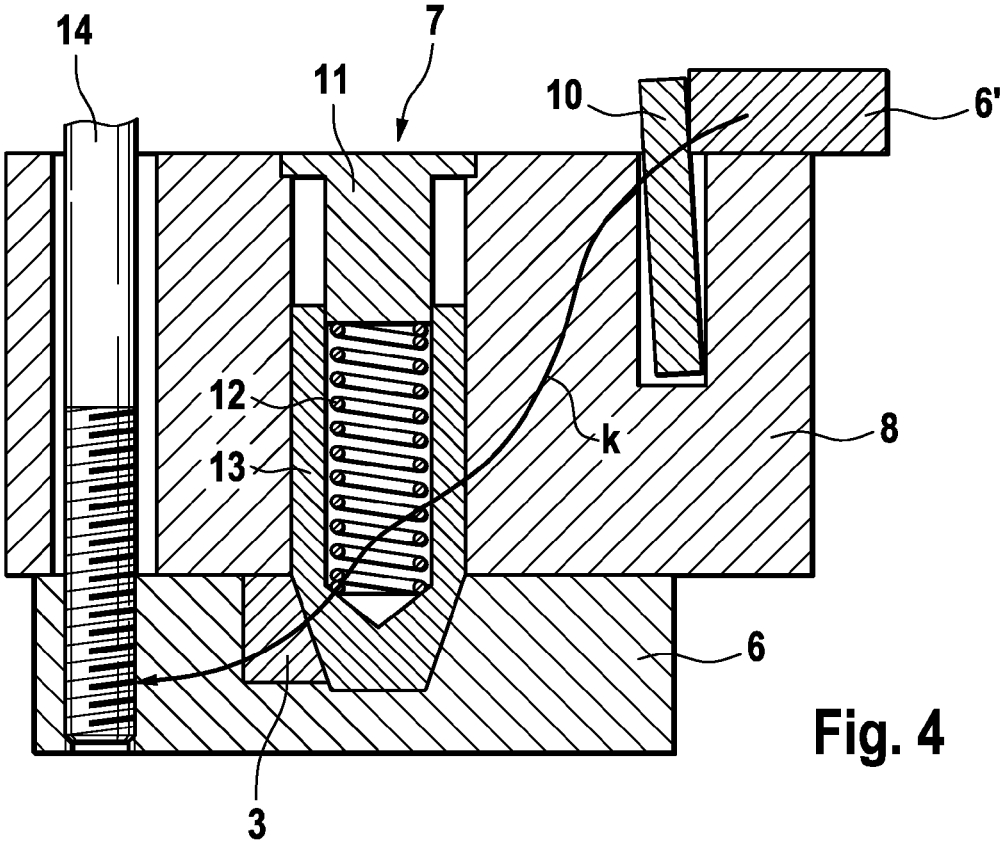
FIG. 4 shows a schematic illustration of a locked camshaft adjustment system with an insert element according to an exemplary embodiment.

FIG. 4 shows schematically the force flux of a locking system for a camshaft adjustment system in the locked state. For the locking operation, the locking element, i.e. a conical pin 7 which is guided in the rotor element 8, enters, as illustrated in FIG. 1, the front cover or the locking cover 6 in which the insert part 3 is also fastened. Conversely, the locking pin 7 may likewise in contrast be introduced directly into the stator element 6' in order to fix the rotor element 8 and the stator element 6, 6'. In the embodiment of FIG. 4, the locking cover 6 is connected to the stator element 6' in a rotationally fixed manner by means of screwing elements 14.

In FIG. 4, the end of the locking element or of the conical pin 7 has a tapering point or a cone with which rotational play between rotor element 8 and stator element 6 can be compensated for. The conical pin comprises a cartridge 11 which can be retracted into a sleeve 13. A spring 12 acts counter to the hydraulic pressure and, upon a sudden drop of the hydraulic pressure, can retract the sleeve 13 into the cutout 9. The conical pin is configured in such a manner that the contact surface formed with the insert element lies just below a self-adhesion limit and so automatic unlocking cannot occur at any time. Accordingly, the spring locking forces of the locking pistons can be adjusted to a low level. In addition, the necessary unlocking pressure is reduced. A small angle of taper of less than 15 degrees with a low adjustment depth has the disadvantage that locking can only take place within a small angular window. In order to reduce the disadvantage, the strength of the locking spring has to be adapted in turn, which in turn involves a high minimum unlocking pressure. The increase in locking spring force can also take place via a pressure-assisted locking.

In addition, FIG. 4 shows a wing 10 which is fastened in the rotor element 8. The wing 10 separates a pressure chamber, which is formed between the stator and the rotor element, into a first and second pressure region. The position of the wing and therefore of the entire rotor element is influenced depending on how much oil pressure is introduced in the respective regions. In the event of a sudden loss of pressure, the situation in which the wing 10 strikes against the stator element 6 in an uncontrolled manner, as illustrated in FIG. 4, has to be prevented.

Owing to the fixing of the locking pin 7 by locking, the striking can be prevented. In addition, the force is transmitted better and so, as early as during the screwing onto the camshaft during the installation process of the engine, the full screwing-on torque can be conducted to the special insert element 3 according to the invention via the conical pin 7. The force flux is clarified by the line k.

Figure 5:
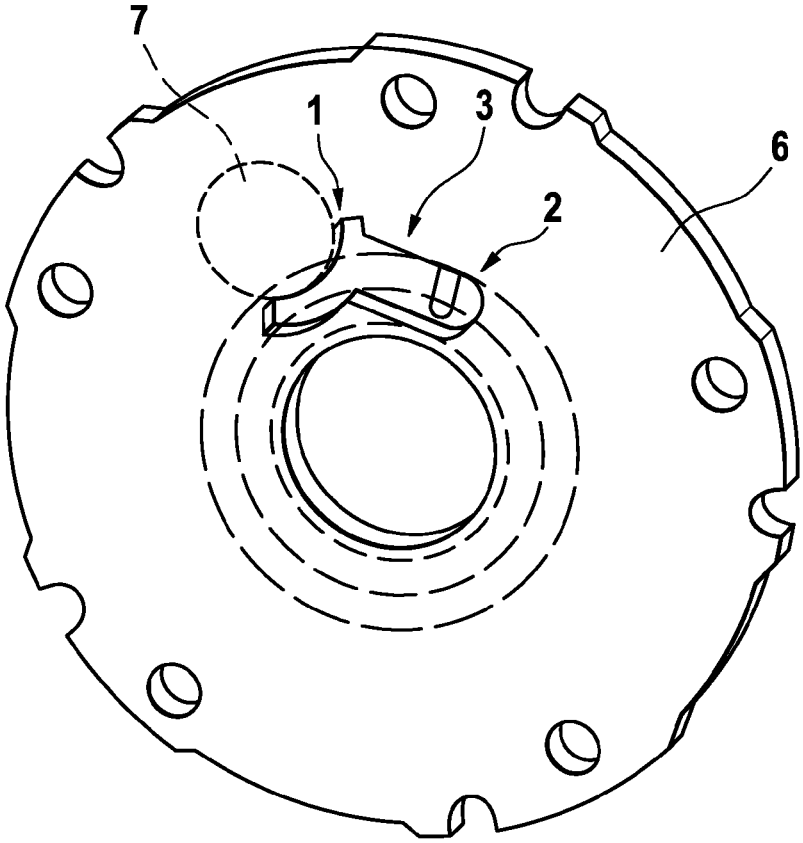
FIG. 5 shows a schematic illustration of a fitted position of the insert element in a stator element.

FIG. 5 shows a schematic view of the insert part 3 according to the invention in a camshaft adjustment system. The insert element 3 is fastened by its second region 2 into a corresponding cutout 9 on the stator element 6 in order to conduct away the force. The stator element 6 may be the stator itself or the locking cover 6 which is connected in a rotationally fixed manner to the stator element 6. With the first region of the insert element 3, a force transmission point can be provided by means of the locking element 7.

Figure 6:
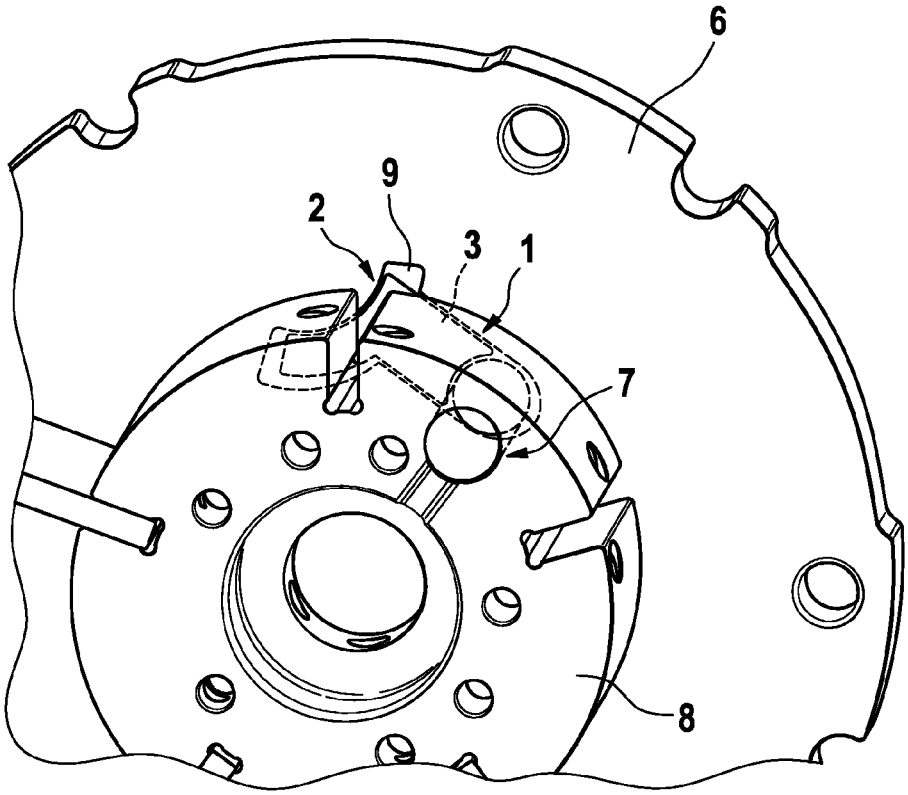
FIG. 6 shows a three-dimensional illustration of the fitted position of the insert element.

FIG. 6 shows a schematic illustration of the camshaft adjustment system with a floating mounting of the insert element 3. The insert element 3 here is mounted in the cutout 9 of the stator element 6. The cutout 9 therefore permits the insert element 3 to have a degree of play. By means of the gothic, i.e. somewhat pointed, or rounded profile shape of the insert element 3 in its second region 2, there is the possibility of following the movement between the stator element 6 and the rotor element 8. In its first region 1, the insert element 3 grips the locking element 7 in order therefore to transmit force in a concentrated manner. In addition, hydraulic lubricating liquid can be placed into the cutout 9 in order therefore to prevent any high degree of wear between the movement of the stator element 6 and of the rotor element 8.

Figure 7:
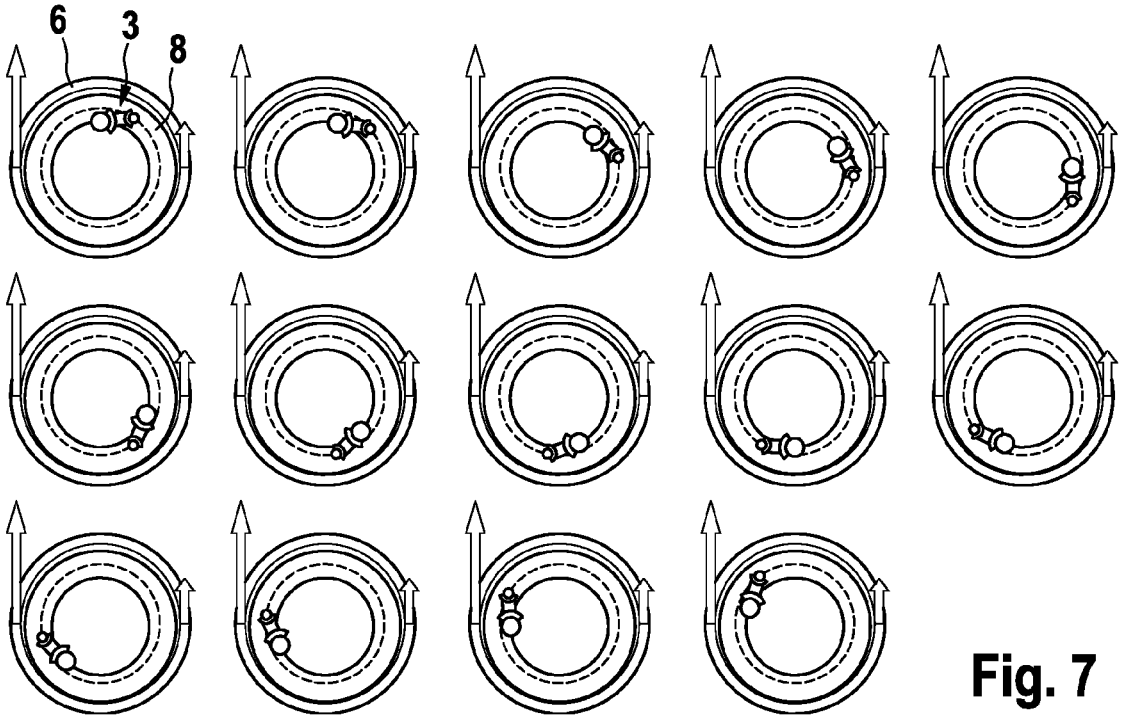
FIG. 7 shows a schematic illustration of a sequence of movement of the insert element during rotation of the rotor.

FIG. 7 shows a sequence of the rotation of the rotor element 8 with the insert element 3 in relation to the stator element 6. There is play between the rotor element 8 and the stator element 6, which play is made apparent by means of the intermediate space in the upper half. Since the centre points of the rotor element 8 and of the stator element 6 are not concentric, the insert element 3, which is fastened to the stator element 6, has to move relative to the locking element which is fastened to the rotor element 8. For this movement, the gothic or the curved profile of the second region 2 of the insert element 3 is of advantage. In addition, if a gothic profile is used, a floating mounting can be used. By means of the floating mounting, the locking piston 7 does not experience any additional loading because of the play-affected mounting between the rotor element 8 and the stator element 6, since the insert part is movable. In addition, the insert element 3 can have diverse lubricating grooves 5, thus reducing premature wear due to the frictional movement.

By means of the distribution of force according to the invention over a large area of the locking cover 6, the latter no longer has to be hardened, as a result of which considerable cost savings are possible. In addition, many different materials can be used, with cast materials, aluminium, steel, sintered materials or plastic being conceivable materials for use. If an aluminium material is used, for example weight savings of 100 grams to 230 grams can be obtained for a camshaft. In addition, owing to the advantageous distribution and transmission of force, the service life of a camshaft adjustment device with an insert element can be increased.

In addition, it should be pointed out that "comprising" does not exclude any other elements or steps and "one" does not exclude more than one. Furthermore, it must be pointed out that features or steps which have been described with reference to one of the above exemplary embodiments can also be used in combination with other features or steps of other exemplary embodiments described above. Reference numbers in the claims are not to be considered limiting.

List Of Designations

1 First region
2 Second region
3 Insert element
4 End surface
5 Groove
6 Locking cover, stator element
7 Locking element
8 Rotor element
9 Cutout
10 Wing
11 Cartridge
12 Spring
13 Sleeve
14 Fastening means, screw
21 Camshaft
22 Crankshaft
k Force flux

The invention claimed is:

1. Insert element for transmitting a force for a camshaft adjustment system, the insert element comprising:

a first region located at an outer periphery of the insert element with an end surface for receiving the force;

a second region located at the outer periphery away from the first region for conducting away the force;

the end surface is arranged such that it has at least one force transmission point for receiving the force, at least one groove is arranged such that the groove divides the end surface into a plurality of partial end surfaces located at the outer periphery;

the force transmission point is arranged such that it can be coupled to a locking element;

the second region is arranged such that it has a force transmission surface for conducting away the force; and the force transmission surface is arranged such that it can be coupled to a stator element.

2. Insert element according to claim 1, wherein the end surface forms a flat surface.

3. Insert element according to claim 1, wherein the end surface is of concave or convex design.

4. Insert element according to claim 1, wherein the end surface is arranged such that it can be coupled to the locking element which has a tapering surface.

5. Insert element according to claim 1, wherein the second region is arranged such that it can be fastened in a receiving region of the stator element.

6. Insert element according to claim 5, wherein the second region can be fastened in the receiving region such that at least one degree of freedom can be provided between the second region and the stator element.

7. Locking arrangement for transmitting a force for a camshaft adjustment system, the locking arrangement comprising:

a locking element;

a stator element; and an insert element having a first region located at an outer periphery of the insert element with an end surface for receiving the force, at least one groove is arranged such that the groove divides the end surface into a plurality of partial end surfaces located at the outer periphery;

a second region located at the outer periphery away from the first region for conducting away the force;

the end surface is arranged such that it has at least one force transmission point for receiving the force;

the force transmission point is arranged such that it can be coupled to the locking element;

the second region is arranged such that it has a force transmission surface for conducting away the force; and the force transmission surface is arranged such that it can be coupled to the stator element.

8. Locking arrangement according to claim 7, wherein the insert element can be mounted in the receiving region by a floating mounting.

9. Locking arrangement according to claim 8, wherein the stator element has a groove for supplying a bearing liquid for the receiving region.

10. Locking arrangement according to claim 7, wherein the locking element comprises a locking pin;

the locking pin has an end region;

the end region has a tapering surface; and the end region and the end surface form the at least one force transmission point.

11. Method for transmitting a force in a camshaft adjustment system, wherein the method comprises:

receiving the force by a locking element by at least one force transmission point of an end surface of an insert element, the end surface including at least one groove arranged such that the groove divides the end surface into a plurality of partial end surfaces located at an outer periphery of the insert element; and conducting the force out of the insert element into a stator element by a force transmission surface of the insert element.

12. Method according to claim 11, wherein the insert element is fastened to a receiving region of the stator element; and the insert element is fastened in such a manner that at least one degree of freedom is provided between the second region and the stator element.

13. Locking arrangement for transmitting a force for a camshaft adjustment system, the locking arrangement comprising:

a locking element;

a stator element; and an insert element having a first region with an end surface for receiving the force, at least one groove is arranged such that the groove divides the end surface into a plurality of partial end surfaces;

a second region for conducting away the force;

the end surface is arranged such that it has at least one force transmission point for receiving the force;

the force transmission point is arranged such that it can be coupled to the locking element;

the second region is arranged such that it has a force transmission surface for conducting away the force;

the force transmission surface is arranged such that it can be coupled to the stator element; and the locking element comprises a locking pin, and the end surface of the insert element for receiving the force is only located on one radial side of the locking pin.

14. Locking arrangement for transmitting a force for a camshaft adjustment system, the locking arrangement comprising:

a locking pin;

a stator element; and an insert element having a first region with an end surface for receiving the force;

a second region for conducting away the force;

the end surface is arranged such that it has at least one force transmission point for receiving the force;

the force transmission point is arranged such that it can be coupled to the locking pin, and the end surface of the insert element for receiving the force is only located on one radial side of the locking pin;

the second region is arranged such that it has a force transmission surface for conducting away the force; and the force transmission surface is arranged such that it can be coupled to the stator element.

* * * * *